United States Patent [19]

Barraclough

[11] Patent Number: 4,984,802

[45] Date of Patent: Jan. 15, 1991

[54] GOLF PUTTING STROKE TRAINER APPARATUS

[76] Inventor: Chet Barraclough, 1271 Poplar Ave., #102-D, Sunnyvale, Calif. 94086

[21] Appl. No.: 500,537

[22] Filed: Mar. 26, 1990

[51] Int. Cl.[5] ..... A63B 69/36

[52] U.S. Cl. ..... 273/192

[58] Field of Search ..... 273/192, 193 A, 193 B, 273/35 R, 186 C, 183 R, 191 R, 186 R

[56] References Cited

U.S. PATENT DOCUMENTS

| | | | |
|---|---|---|---|
| 1,545,648 | 7/1925 | Fletcher | 273/192 |
| 2,894,755 | 7/1959 | Scelzo | 273/192 |
| 3,886,116 | 2/1975 | Ford et al. | 273/192 |
| 4,322,084 | 3/1982 | Reece et al. | 273/192 |
| 4,423,875 | 1/1984 | Miller | 273/192 |

*Primary Examiner*—Theatrice Brown

*Attorney, Agent, or Firm*—Leon Gilden

[57] ABSTRACT

An apparatus including a first rigid longitudinal side member spaced from a second rigid longitudinal side member, wherein each first and second side member includes an orthogonally and integrally mounted leg, wherein each leg includes a respective slot, wherein the slots are in aligned relationship relative to one another with a securement member to permit relative repositionment of one leg relative to the other leg to permit a spatial adjustment between the sides. Forward ends of each side at an uppermost edge thereof include an adjustment member to permit alignment and adjustment of the uppermost edges relative to one another. The bottom surfaces of the sides each include a downwardly projecting pin and are orthogonally oriented relative to each bottom end surface to permit projection of the pins to a support underlying surface, such as a soil or carpet to rigidly and fixedly arrange the organization in use. Elastomeric members are mounted to each end of the organization, with a golf club mounted within the elastomeric members to provide resistance to the club during use. The forward end of the organization is open to permit directing of a golf ball exteriorly therefrom in use.

5 Claims, 4 Drawing Sheets

GOLF PUTTING STROKE TRAINER APPARATUS

BACKGROUND OF THE INVENTION

1. Field of the Invention

The field of invention relates to golf putting apparatus, and more particularly pertains to a new and improved golf putting stroke trainer apparatus wherein the same permits adjustment and exercise training of a golf stroke by a golfer to provide and train a consistently repeatable putting stroke.

2. Description of the Prior Art

The prior art has set forth various training aids to permit golfers to practice various golf strokes. Such prior art devices have not been completely satisfactory due to their permitting various repositioning of a golf club during a stroking procedure, or alternatively permit excessive wrist rotation while a golfer secures a golf club negating effective golf stroke training requiring a straight line repeatable golf swing during use. Examples of the prior art include U.S. Pat. No. RE 32,397 to Self, et al., wherein aligned elastomeric members, including a central loop receive a golf club therebetween, with underlying alignment member to permit visual alignment of the golf club during a stroking procedure.

U.S. Pat. No. 4,423,875 to Miller provides a golf training aid wherein spaced telescoping rails are pivotally mounted at their forward and rear ends to align a golf stroke during use.

U.S. Pat. No. 4,230,319 to Liner provides a putting stroke practice device utilizing flexible side webs mounted to forward and rear rigid plates to permit detection of a faulty golf swing.

U.S. Pat. No. 4,334,684 to Sterling wherein a rigid jig member is slidably mounted about spaced parallel rails to effect practice of a golf swing.

U.S. Pat. No. 2,894,755 to Scelzo sets forth a golf practice device wherein a plurality of spaced bars mounted overlying a surface wherein the spaced bar is provided visual alignment of a golf swing for practicing thereof.

As such, it may be appreciated that there continues to be a need for a new and improved golf putting stroke trainer apparatus wherein the same addresses both the problems of ease of use, as well as effectiveness in construction in permitting a repeated golf swing and exercise thereof in a repeatable manner to effect improvement of a golf swing in the playing of the game of golf.

SUMMARY OF THE INVENTION

In view of the foregoing disadvantages inherent in the known types of golf putting apparatus now present in the prior art, the present invention provides a golf putting stroke trainer apparatus wherein the same utilizes a rigid "U" shaped enclosure to direct and enclose a golf swing by an associated golf club to effect training and practice thereof, as well as utilizing elastomeric bands to enhance exercise of associated muscles utilized in a golf putting stroke. As such, the general purpose of the present invention, which will be described subsequently in greater detail, is to provide a new and improved golf putting stroke trainer apparatus which has all the advantages of the prior art golf putting apparatus and none of the disadvantages.

To attain this, the present invention provides an apparatus including a first rigid longitudinal side member spaced from a second rigid longitudinal side member, wherein each first and second side member includes an orthogonally and integrally mounted leg, wherein each leg includes a respective slot, wherein the slots are in aligned relationship relative to one another with a securement member to permit relative repositionment of one leg relative to the other leg to permit a spatial adjustment between the sides. Forward ends of each side at an uppermost edge thereof include an adjustment member to permit alignment and adjustment of the uppermost edges relative to one another. The bottom surfaces of the sides each include a downwardly projecting pin and are orthogonally oriented relative to each bottom end surface to permit projection of the pins to a support underlying surface, such as a soil or carpet to rigidly and fixedly arrange the organization in use. Elastomeric members are mounted to each end of the organization, with a golf club mounted within the elastomeric members to provide resistance to the club during use. The forward end of the organization is open to permit directing of a golf ball exteriorly therefrom in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf putting stroke trainer apparatus which has all the advantages of the prior art golf putting apparatus and none of the disadvantages.

It is another object of the present invention to provide a new and improved golf putting stroke trainer apparatus which may be easily and efficiently manufactured and marketed.

It is a further object of the present invention to provide a new and improved golf putting stroke trainer apparatus which is of a durable and reliable construction.

An even further object of the present invention is to provide a new and improved golf putting stroke trainer apparatus which is susceptible of a low cost of manufacture with regard to both materials and labor, and which accordingly is then susceptible of low prices of sale to the consuming public, thereby making such golf putting stroke trainer apparatus economically available to the buying public.

Still yet another object of the present invention is to provide a new and improved golf putting stroke trainer apparatus which provides in the apparatuses and methods of the prior art some of the advantages thereof, while simultaneously overcoming some of the disadvantages normally associated therewith.

Still another object of the present invention is to provide a new and improved golf putting stroke trainer apparatus wherein the same provides exercise and training of a repeatable golf swing for use in a putting stroke.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
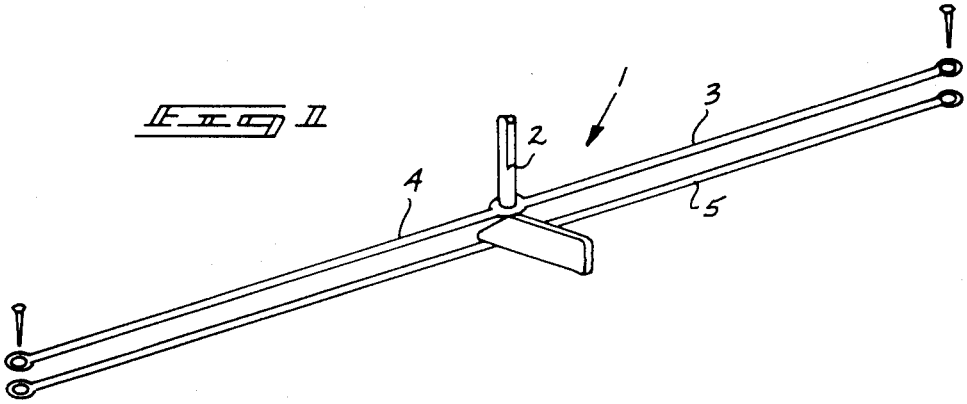
FIG 1 PRIOR ART
FIG. 1 is an isometric illustration of a prior art golf stroke trainer apparatus.

With reference now to the drawings, and in particular to FIGS. 1 to 8 thereof, a new and improved golf putting stroke trainer apparatus embodying the principles and concepts of the present invention and generally designated by the reference numeral 10 will be described.

Figure 2:
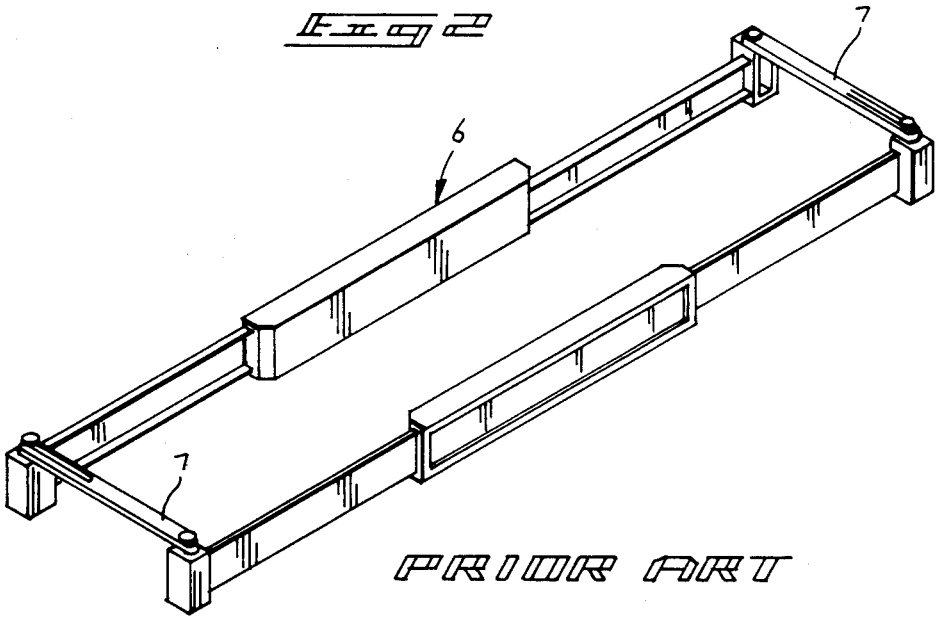
FIG 2 PRIOR ART
FIG. 2 is an isometric illustration of a further prior art golf putting stroke trainer apparatus.
Figure 3:
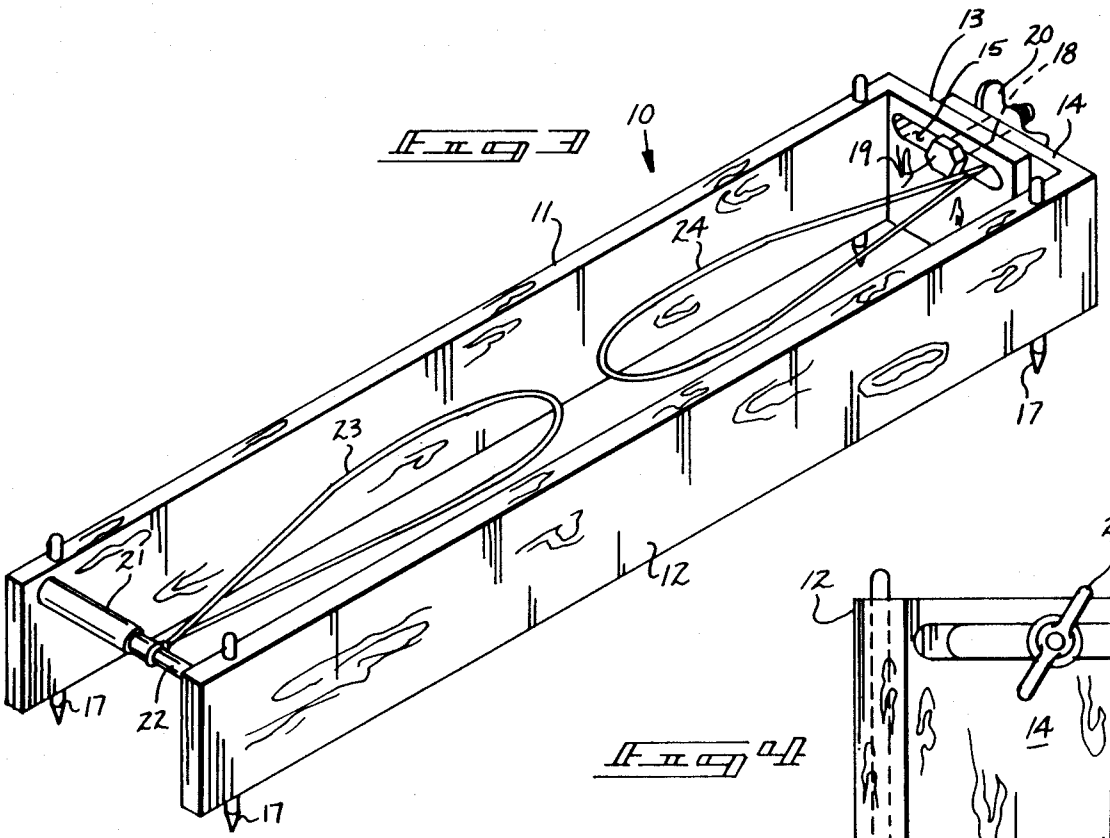
FIG. 3 is an isometric illustration of the instant invention.

FIG. 1 is an isometric illustration of a prior art golf stroke apparatus 1, wherein a golf club 2 is mounted within a central ring integrally secured to a forward and rear respective elastomeric band 3 and 4 overlying an alignment band 5, wherein the bands are mounted at their opposite ends and a golf swing is directed overlying the alignment band. FIG. 2 illustrates a further prior art golf swing member 6, wherein telescoping sides include adjustment members 7 at each end thereof to provide an enclosure for a golf swing, and wherein the adjustment members 7 are pivotally mounted at their forward and rear ends.

Figure 4:
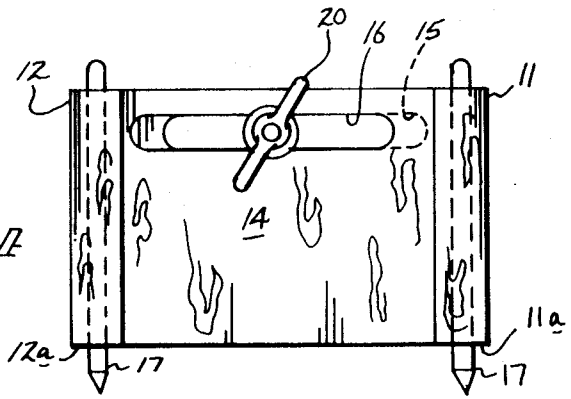
FIG. 4 is an orthographic rear end view taken in elevation of the instant invention.
Figures 5, 6:
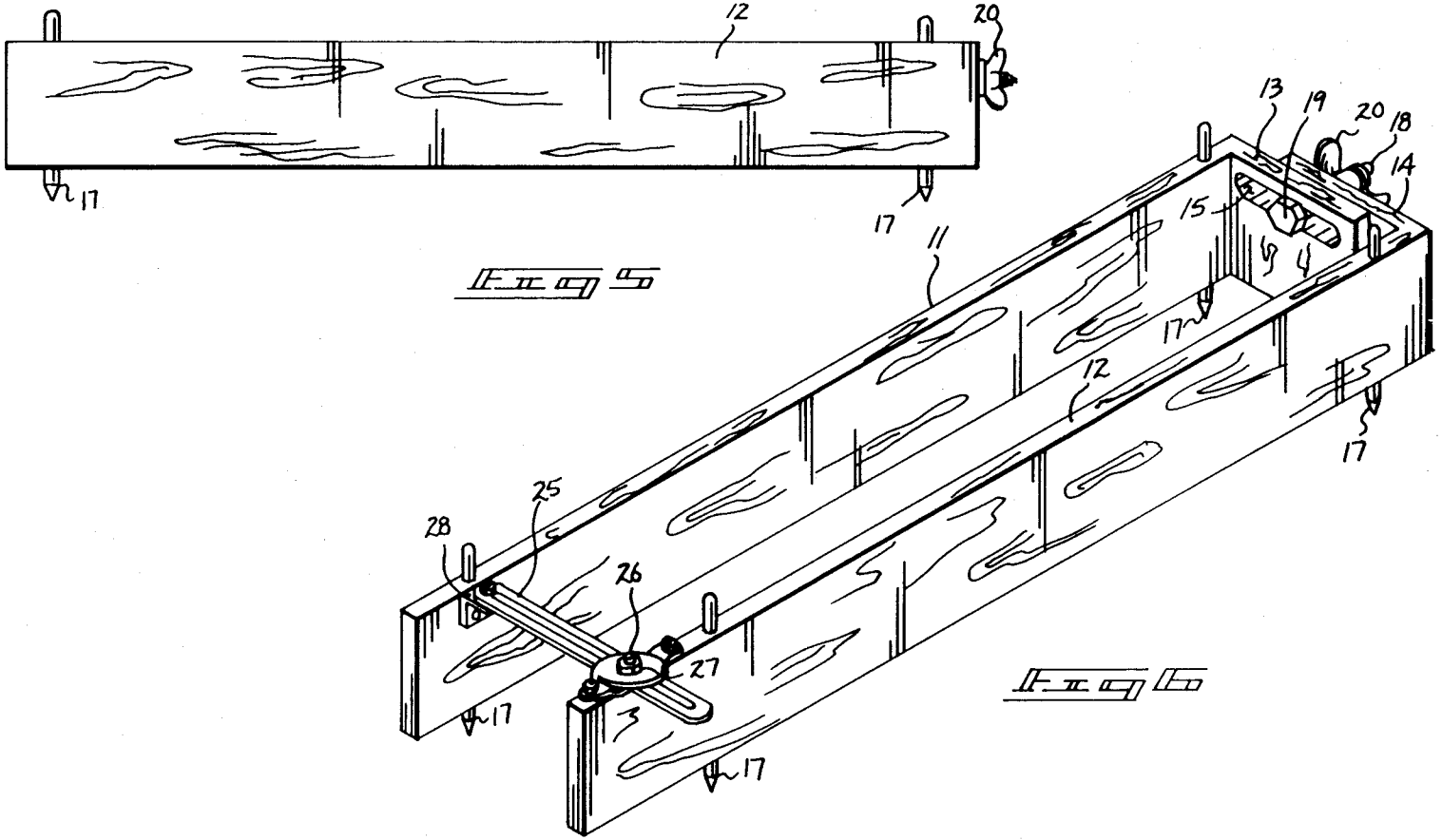
FIG. 5 is an orthographic left side view taken in elevation of the instant invention.
FIG. 6 is an isometric illustration of the instant invention utilizing a modified forward adjustment member.

More specifically, the golf putting stroke trainer apparatus 10 of the instant invention essentially comprises a first longitudinally aligned rigid side member 11 including planar interior and exterior side surface, wherein the side 11 is arranged parallel to a second longitudinally aligned rigid side 12 including associated respective interior and exterior side surfaces. Each respective side 11 and 12 includes a respective first and second bottom end surface 11*a* and 12*a*, as illustrated in FIG. 4. The bottom surfaces 11*a* and 12*a* each include a projecting pin 17 arranged orthogonally relative to each bottom surface 11*a* and 12 and directed downwardly adjacent each end of each bottom surface. The pins 17 fixedly mount the organization in use into a respective support surface, such as a carpet or an underlying soil or sod environment.

Figures 7, 8:
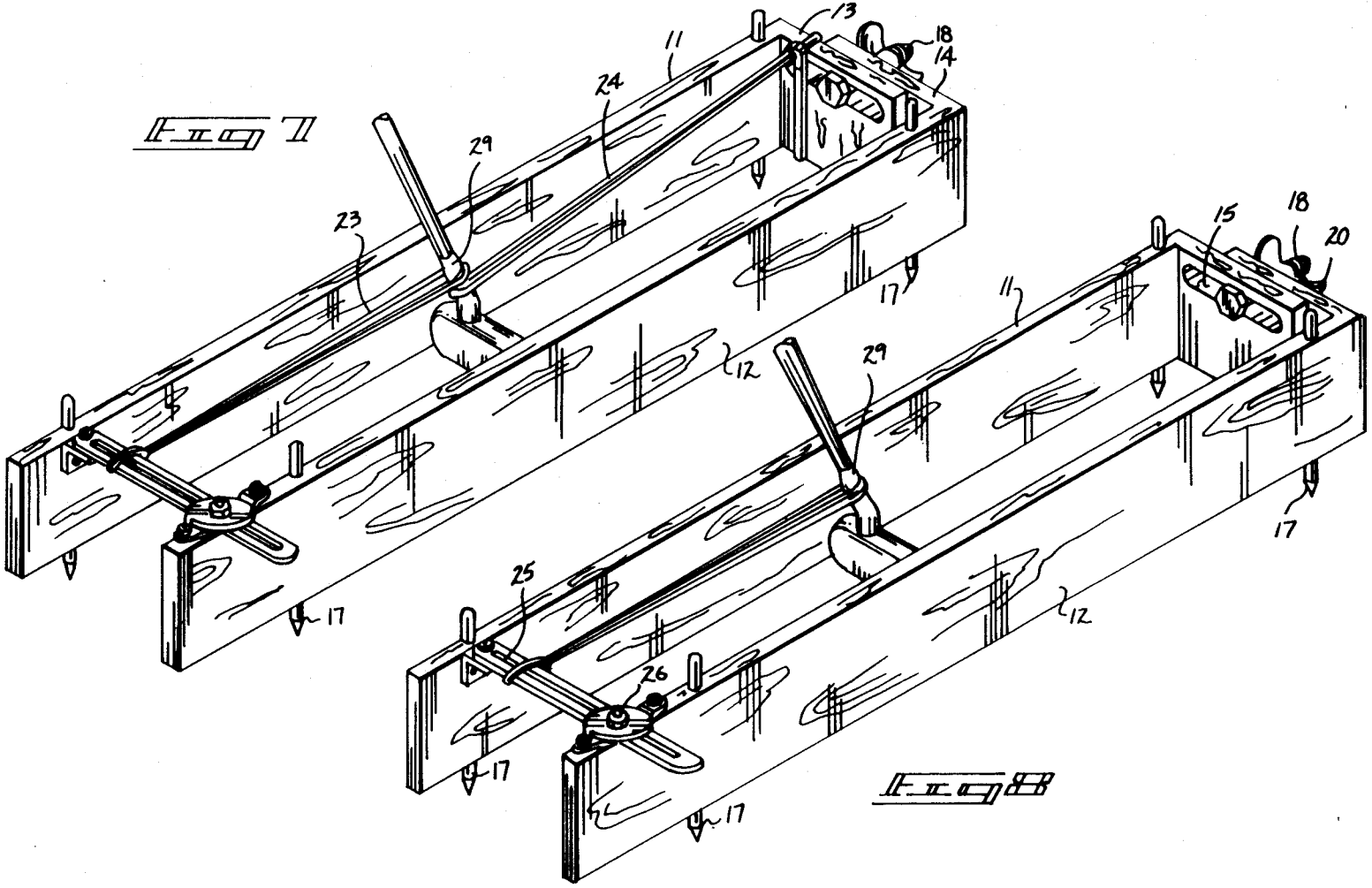
FIG. 7 is an isometric illustration of the instant invention in use with aligned elastomeric exercise bands.
FIG. 8 is an isometric illustration of the instant invention utilizing a forward band only in exercising of a golf swing.

A first rigid end leg 13 is orthogonally mounted to a lower terminal end of the first side 11, with a second end leg 14 orthogonally mounted to a rear end portion of the second side 12, wherein the respective first and second end legs 13 and 14 each include a respective interior and exterior surface, wherein an interior surface of the leg 14 is in confronting sliding relationship relative to an exterior surface of the first end leg 13. Each end leg 13 and 14 includes a respective first and second elongate slot 15 and 16 arranged longitudinally of each end leg, and wherein each slot is in an aligned overlying relationship relative to one another to receive a clamp bolt 18 therethrough. The clamp bolt 18 includes an enlarged head 19 mounted on an interior surface of the first leg 13 cooperating with a clamping nut 20 mounted on an exterior surface of the second leg 14 to selectively secure the end legs together in a fixed relationship. The forward ends of each side 11 and 12 are adjustable relative to one another, wherein a sleeve 21 is orthogonally and integrally mounted to an interior upper end of the interior surface of the first side 11 telescopingly receiving a tube 22 orthogonally and integrally mounted to an interior surface of the second side 12, wherein the tube and sleeve 21 and 22 are coaxially and slidably arranged in a frictional relationship relative to one another. The tube and sleeve are positioned adjacent a top end surface of the respective sides 11 and 12 to provide an open forward end of the generally "U" shaped enclosure defined by the sides and end legs to permit a golf ball to be directed exteriorly of the enclosure in use. A first elastomeric loop 23 is mounted to the adjustment means defined by the sleeve and tube 21 and 22, with a second elastomeric loop 24 mounted to the end legs 13 and 14. The elastomeric loops 23 and 24 engage a golf club shaft 29 adjacent the head end of the golf club, as illustrated in FIG. 7, to permit practicing of a golf swing. In use, a single first or second elastomeric loop 23 or 24 may be utilized to emphasize practice of a portion of a golf swing.

An alternative adjustment member 25 may be utilized defined by a slotted bar 25 receiving a threaded boss 26 directed orthogonally and upwardly from a top end surface of the second side 12, including a clamping nut 27 to secure the slotted bar in a fixed relationship relative to the second side 12 with a rear end portion of the slotted bar 25 mounted to a support bracket 28 whose top surface is aligned with a top surface of the first side 11 to provide the same opened forward end of the defined enclosure. In use, the defined enclosure is defined by a generally rectangular cross-sectional parallelepiped configuration. The head of the golf club is preferably arranged with approximately one-eighth inch to one-fourth inch clearance relative to interior surfaces of the first and second sides. Repetition of such a golf swing with minimal clearance with repeated practice will effectively provide a repeatable golf putting stroke for use in an associated game to enhance and improve an individual's putting stroke. It is also understood that the bottom surface of the head of the golf club is maintained adjacent the underlying support surface, such as a carpet or sod surface, in use of the enclosure when mounted to such a support surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf putting stroke trainer apparatus comprising, a "U" shaped housing including a first longitudinal rigid side spaced from and parallel to a second longitudinal rigid side, the first rigid side including a first interior surface and a first exterior surface, and the second side including a second interior surface and a second exterior surface, wherein the first and second interior surfaces are arranged in confronting parallel relationship relative to one another and defined by a predetermined height, and the first and second sides each including a respective first and second rear terminal end, the first rear terminal end including a first end leg rigidly mounted thereto, and the second rear terminal end including a second end leg rigidly mounted thereto, wherein the first and second end legs are adjustably mounted relative to one another, and the first and second sides including a respective first and second forward terminal end, the first and second terminal ends each including a respective first and second alignment member, wherein the first and second alignment members are adjustable relative to one another to align the first and second forward terminal ends relative to one another, and wherein the first and second end legs are orthogonally mounted to the respective first and second rear terminal ends of the respective first and second sides, and wherein the first end leg includes a first slot longitudinally aligned with the first end leg and the second end leg includes a second slot longitudinally aligned with the second end leg, and wherein the first and second slots are in an aligned overlying relationship relative to one another, and the first and second end legs are arranged in a contiguous sliding relationship relative to one another, and a clamp member is directed through the first and second slots to selectively clamp the first end leg relative to the second end leg.

2. An apparatus as set forth in claim 1 wherein the first and second alignment members includes a respective sleeve fixedly and orthogonally mounted to the first interior surface of the first side, and the second alignment member includes a tube fixedly and orthogonally mounted to the second interior surface of the second side, wherein the tube is telescopingly and frictionally receivable within the sleeve.

3. An apparatus as set fourth in claim 2 further including a first elongate elastomeric loop mounted to the tube, and a second elastomeric loop mounted to the first and second end leg, and a golf club shaft mounted within the first and second elastomeric loops, and further including a golf club head mounted to a lower terminal end of the golf club shaft, wherein the golf club head is slidingly received within the respective first and second interior surfaces of the first and second sides, and the golf club head is orthogonally arranged and aligned between the first and second interior sides.

4. An apparatus as set forth in claim 3 wherein the first and second sides each include a respective first and second bottom and surface, the first and second bottom end surfaces each including a plurality of pins integrally and orthogonally directed downwardly from each respective first and second bottom end surface, each of the pins rigidly mounted to each respective first and second bottom end surface and projecting downwardly therefrom for securement of the enclosure with an underlying support surface.

5. An apparatus as set forth in claim 4 wherein the first alignment member includes a slotted bar mounted orthogonally relative to the first interior side, and the second alignment member includes a projecting boss orthogonally mounted to an upper surface of the second side, wherein the boss is received within the slotted member to permit adjustment of the first side relative to the second side.

* * * * *